US005997351A

United States Patent [19]

Okabe

[11] Patent Number: 5,997,351

[45] Date of Patent: Dec. 7, 1999

[54] WATERPROOF PRESS-CONNECTING CONNECTOR AND PRESS-CONNECTING METHOD

[75] Inventor: Toshiaki Okabe, Shizuoka, Japan

[73] Assignee: Yazaki Corporation, Tokyo, Japan

[21] Appl. No.: 09/037,871

[22] Filed: Mar. 10, 1998

[30] Foreign Application Priority Data

Mar. 13, 1997 [JP] Japan ..... P-9-059554

[51] Int. Cl.[6] ..... H01R 13/40

[52] U.S. Cl. ..... 439/587; 439/274; 439/275; 439/279

[58] Field of Search ..... 439/587, 274, 439/275, 279

[56] References Cited

U.S. PATENT DOCUMENTS

| | | | |
|---|---|---|---|
| 3,818,420 | 6/1974 | Barr | 439/274 |
| 4,944,688 | 7/1990 | Lundergan | 439/275 |
| 5,266,045 | 11/1993 | Yamamoto et al. | 439/275 |
| 5,613,868 | 3/1997 | Ohsumi et al. | 439/275 |
| 5,618,206 | 4/1997 | Sawada et al. | 439/274 |
| 5,865,636 | 2/1999 | Myer et al. | 439/275 |

FOREIGN PATENT DOCUMENTS

| | | | |
|---|---|---|---|
| 5-152028 | 6/1993 | Japan | H01R 12/52 |

*Primary Examiner*—Renee S. Luebke
*Assistant Examiner*—Hae Moon Hyeon
*Attorney, Agent, or Firm*—Sughrue, Mion, Zinn Macpeak & Seas, PLLC

[57] ABSTRACT

There is disclosed a waterproof press-connecting connector in which when press-connecting sheathed wires respectively to press-connecting terminals, a rubber plug is prevented from moving to be disposed on the press-connecting terminals. In the waterproof press-connecting connector 15, there is provided positioning retaining means 21 for supporting the rubber plug 20, through which wires 7 are passed, at a rear end (defining a wire lead-out side) of a housing 18 in a provisionally-retained position where the end portions 7*a* of the wires are disposed respectively above press-connecting portions 23, and the rubber plug 20 is prevented from moving in a direction of axes of the wires, and in a completely-retained position where the wire end portions 7*a* are press-fitted respectively into the press-connecting portions 23. With this construction, the rubber plug 20 is prevented from moving in the direction of the axes of the wires 7.

7 Claims, 4 Drawing Sheets

WATERPROOF PRESS-CONNECTING CONNECTOR AND PRESS-CONNECTING METHOD

BACKGROUND OF THE INVENTION

This invention relates to a waterproof press-connecting connector in which a rear end portion of a housing, receiving press-connecting terminals each having press-connecting blades between which an end portion of a wire is press fitted, is waterproofed by a rubber plug.

FIG. 1 shows a waterproof press-connecting connector 1 disclosed in Japanese Patent Unexamined Publication No. Hei. 5-152028. This waterproof press-connecting connector 1 comprises a housing 4 having terminal receiving chambers 3 for respectively receiving press-connecting terminals 2, a tubular cover 5 receiving the housing 4 therein to cover the same, and a rubber plug 6 closing one open end of the cover 5.

The press-connecting terminal 2 includes press-connecting blades, and an end portion 7*a* of a sheathed wire 7 is press fitted between these press-connecting blades to be connected to the terminal 2. The rubber plug 6 has a plurality of wire insertion holes 8, and the end portions 7*a* of the sheathed wires 7, passed respectively through the wire insertion holes 8, are press fitted to the press-connecting terminals 2, respectively.

In FIG. 1, reference numeral 9 denotes a seal ring inserted into the other open end of the cover 5, reference numeral 10 a mating connector, and reference numeral 11 a packing.

For connecting the waterproof press-connecting connector 1 to the end portions 7*a* of the sheathed wires 7, the end portions 7*a* of the sheathed wires 7, passed respectively through the insertion holes 8 in the rubber plug 6, are located respectively above press-connecting portions 12 of the press-connecting terminals 2 received respectively in the terminal receiving chambers 3 in the housing 4, and then are pressed by a press-connecting jig 13 from the upper side, as shown in FIG. 2(*a*). As a result of the pressing operation by the press-connecting jig 13, the end portions 7*a* of the sheathed wires 7 are press-connected respectively to the press-connecting terminals 2 to be electrically connected thereto. In this condition, the housing 4 is inserted into the cover 5, and the rubber plug 6 is fitted in the one open end of the cover 5 in such a manner that the rubber plug 6 is held in intimate contact with the inner peripheral surface of the one open end. As a result, the press-connecting terminals 2 and the end portions 7*a* of the sheathed wires 7 are received in a waterproofed manner within the cover 5.

However, generally, the sheath of the sheathed wire 7 contains an oily component, and therefore has a low friction coefficient, and the rubber plug 6 is liable to move in the direction of the axes of the sheathed wires 7 as shown in FIG. 2(*a*). As a result, the rubber plug 6 is moved to be disposed above the press-connecting terminals 2, and in this condition, when the sheathed wire 7 is pressed toward the press-connecting terminal 2 by the press-connecting jig 13, the rubber plug 6 is held between the press-connecting terminal 2 and the press-connecting jig 13, which results in a problem that the sheathed wire 7 can not be properly connected to the press-connecting terminal 2.

SUMMARY OF THE INVENTION

It is an object of this invention to provide a waterproof press-connecting connector, as well as a press-connecting method, in which a rubber plug will not be moved to be disposed above press-connecting terminals when press-connecting sheathed wires to the press-connecting terminals.

The above object has been achieved by a waterproof press-connecting connector, according to the present invention, comprising:

a housing having terminal receiving chambers for respectively receiving press-connecting terminals each having a press-connecting portion into which an end portion of a wire is press fitted to make an electrical connection between the wire end portion and the terminal;

a tubular cover for receiving and covering the housing;

a rubber plug, through which the wires connected respectively to the press connecting terminal are passed, for closing one open end of the cover to waterproof the interior of the cover; and a positioning and retaining means for supporting the rubber plug, through which the wires are passed, at a rear end defining a wire lead-out side of the housing, to thereby prevent the rubber plug from moving in a direction of axes of the wires.

In the above-mentioned construction, preferably, the rubber plug is positioned and retained by the positioning and retaining means in one of a provisionally-retained position where the rubber plug is provisionally retained relative to the housing so as to prevent the rubber plug from moving in a direction of axes of the wires, and a completely-retained position where the rubber plug is completely retained relative to the housing.

In addition, in the above-mentioned construction, preferably, the rubber plug is positioned and retained by sthe positioning and retaining means in one of a provisionally-retained position, where the end portions of sthe wires are disposed respectively above sthe press-connecting portions and sthe rubber plug is prevented from moving in a direction of axes of sthe wires, and a completely-retained position, where sthe wire end portions are press-fitted respectively into sthe press-connecting portions.

In this waterproof press-connecting connector, when the end portions of the sheathed wires are to be press fitted respectively in the press-connecting portions of the press-connecting terminals, the rubber plug is supported in the provisionally-retained position by the positioning retaining means, and in this condition each wire end portion is press fitted between press-connecting blades of the associated press-connecting terminal. After the sheathed wire is press fitted between the press-connecting blades, the rubber plug is held in the completely-retained position by the positioning retaining means. Therefore, the end portion of the sheathed wire can be properly press fitted between the press-connecting blades of the press-connecting terminal.

In the above-mentioned construction according to the invention, preferably, the positioning retaining means includes a pair of projections projecting from the rear end of the housing in a direction opposite to a direction of press-fitting of the wire end portions into the respective press-connecting portions, a pair of holes which are formed in the rubber plug, and in which the projections are fitted, respectively, and support portions which respectively support the pair of projections in the pair of holes so that the rubber plug can be retained relative to the housing in the provisionally-retained position and the completely-retained position.

In this waterproof press-connecting connector, when press-fitting the sheathed wires respectively into the press-connecting blade portions of the press-connecting terminals, the projections are inserted respectively into the holes, and are supported respectively by the support portions, thereby supporting the rubber plug in the provisionally-retained position. In this condition, the sheathed wires are press fitted respectively into the press-connecting blade portions, and thereafter the rubber plug is supported in the completely-retained position by the positioning retaining means.

Further, in the above-mentioned construction, more preferably, the holes are formed respectively in a pair of block-like extension portions formed on that side of the rubber plug facing the housing, and each of the projections comprises a cylindrical boss, and the support portions are defined respectively by thin walls which are formed respectively in the holes intermediate opposite ends thereof, and abut respectively against the bosses, inserted respectively into the holes, to support the rubber plug in the provisionally-retained position, and when the bosses are further inserted respectively into the holes, the thin walls are broken through by the bosses, respectively, to allow the rubber plug to move to the completely-retained position.

In this waterproof press-connecting connector, when press-fitting the sheathed wires respectively into the press-connecting blade portions of the press-connecting terminals, the bosses, formed on the housing, are inserted respectively into the tubular holes formed in the rubber plug, and the distal ends of the bosses are abutted respectively against the thin walls, thereby holding the rubber plug in the provisionally-retained position. In this condition, the sheathed wires are press-fitted respectively into the press-connecting blade portions. After the sheathed wires are thus press-fitted respectively into the press-connecting blade portions, the rubber plug is moved to the completely-retained position. As a result of this movement, the distal end of each boss breaks through the thin wall, and the boss is further inserted into the hole, thereby moving the rubber plug to the completely-retained position.

Further more, in the above-mentioned construction of the present invention, preferably, a head for preventing the projection from being withdrawn from the hole is formed at a distal end of each of the projections.

In this waterproof press-connecting connector, when the rubber plug is located in the provisionally-retained position and in the completely-retained position, the heads, formed respectively on the distal ends of the projections, prevent the projections from being withdrawn respectively from the holes, thus holding the rubber plug in the provisionally-retained position and in the completely-retained position.

The above-mentioned object can also be achieved by a press-connecting method of pressing connecting end portions of wires respectively to press-connecting terminals in a waterproof press-connecting connector, the press-connecting method, according to the present invention, comprising the following steps in the sequence set forth:

disposing a rubber plug, through which the wires has been passed, at a provisionally-retained position where the rubber plug is provisionally retained relative to a housing so as to prevent the rubber plug from moving in a direction of axes of the wires;

placing and fitting the end portions of the wire respectively on the press-connecting portions of the press-connecting terminals;

disposing the rubber plug at the completely-retained position where the rubber plug is completely retained relative to the housing.

In this press-connecting method, the rubber plug, through which the wires pass, is located in the provisionally-retained position, and in this condition the wire end portions are press-fitted respectively into the press-connecting blade portions. After the wire end portions are press-fitted respectively into the press-connecting blade portions, the rubber plug is located in the completely-retained position. In this case, the wire end portions are press-fitted respectively into the press-connecting blade portions while the rubber plug is located in the provisionally-retained position, and therefore each wire end portion can be properly press-fitted into the press-connecting blade portion, and can be electrically connected thereto.

BRIEF DESCRIPTION OF THE DRAWINGS

FIG. 2(*b*) is a cross-sectional view of the conventional waterproof press-connecting connector, showing a condition in which the rubber plug is pressed against a press-connecting terminal;

FIG. 6(*b*) is a cross-sectional view showing a condition in which the rubber plug is located and supported in a completely-retained position.

DESCRIPTION OF THE PREFERRED EMBODIMENT OF THE INVENTION

A preferred embodiment of a press-connecting connector, as well as a press-connecting method of the invention, will now be described.

Figure 1:
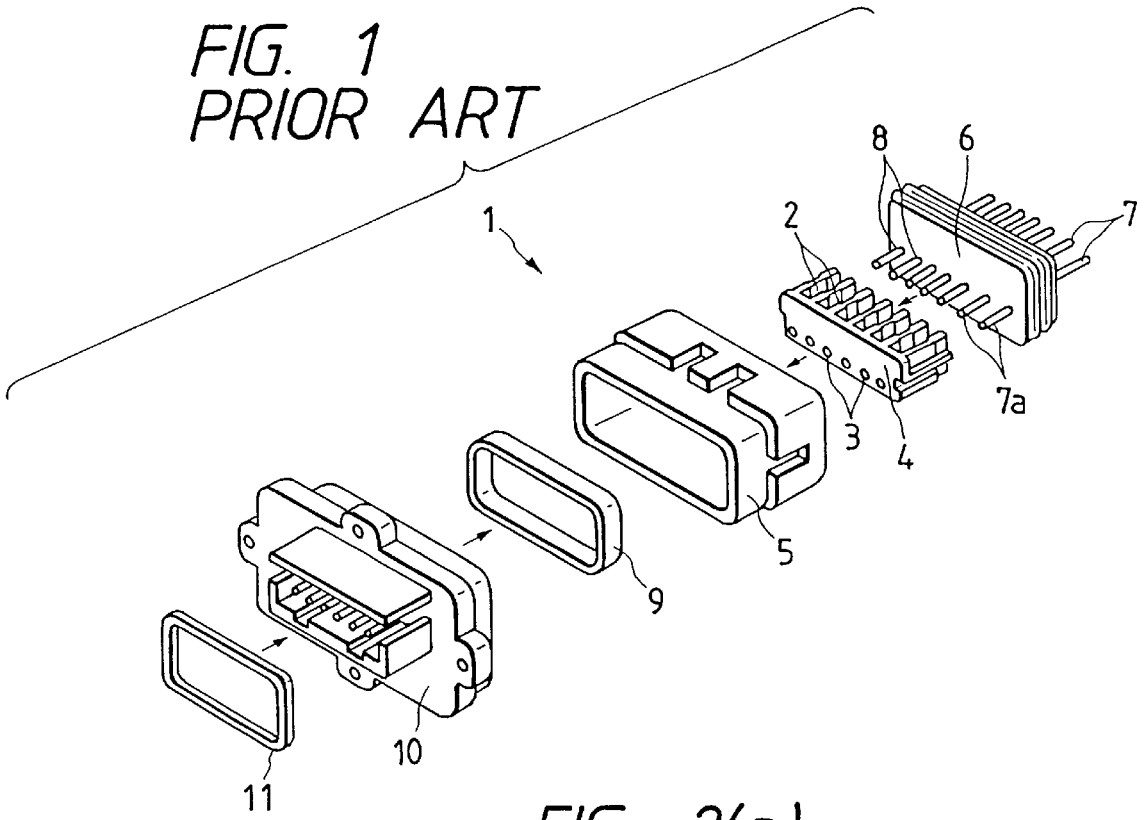
FIG. 1 PRIOR ART
FIG. 1 is a perspective view showing a conventional waterproof press-connecting connector.
Figure 2A:
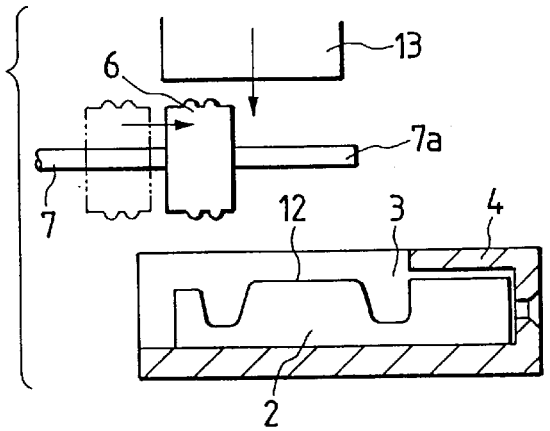
FIG. 2(a) PRIOR ART
FIG. 2(*a*) is a cross-sectional view of the conventional waterproof press-connecting connector, showing a condition in which a rubber plug is displaced in a direction of an axis of a wire.
Figure 2B:
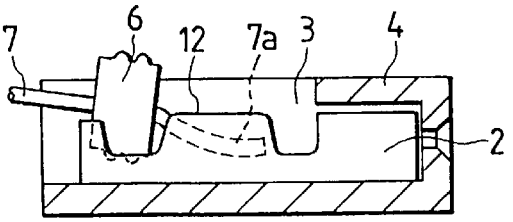
FIG. 2(b) PRIOR ART
Figure 3:
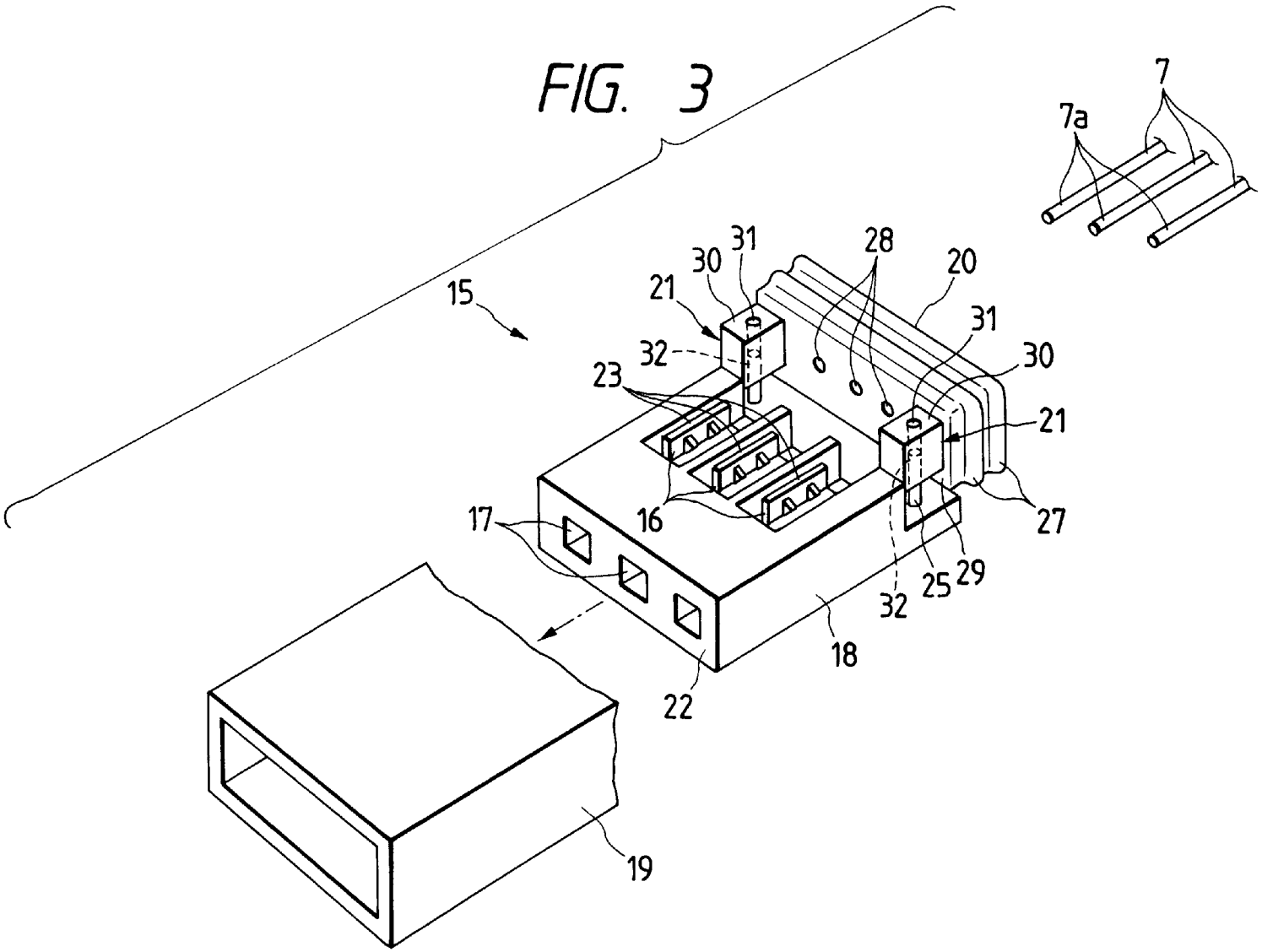
FIG. 3 is a perspective view of a waterproof press-connecting connector of the present invention.

FIG. 3 shows one preferred embodiment of a waterproof press-connecting connector 15 of the invention. This waterproof press-connecting connector 15 comprises a housing 18 having a plurality of terminal receiving chambers 17 for respectively receiving press-connecting terminals 16, a cover 19 receiving the housing 18 to cover the same, and a rubber plug 20 which is provided at a rear end (wire lead-out side) of the housing 18, and closes one open end of the cover 19. The waterproof press-connecting connector 15 of this embodiment is provided with positioning retaining means 21 for supporting the rubber plug 20 in a provisionally-retained position and a completely-retained position.

The terminal receiving chambers 17 are open to a front end surface 22 of the housing 18 which is to face a mating connector. Rear end portions of the terminal receiving chambers 17 are upwardly open. Press-connecting portions 23 of the press-connecting terminals 16 (see FIG. 6) are received respectively in these upwardly-open portions, and end portions 7*a* of sheathed wires 7 are press-fitted respectively into the press-connecting terminals 16 through these upwardly-open portions. A rubber plug support portion 24 extends from the rear end of the housing 18. A pair of projections 25 and 25 are formed on the rubber plug support portion 24. The projection 25 comprises a cylindrical boss having a head 26.

Figure 4:
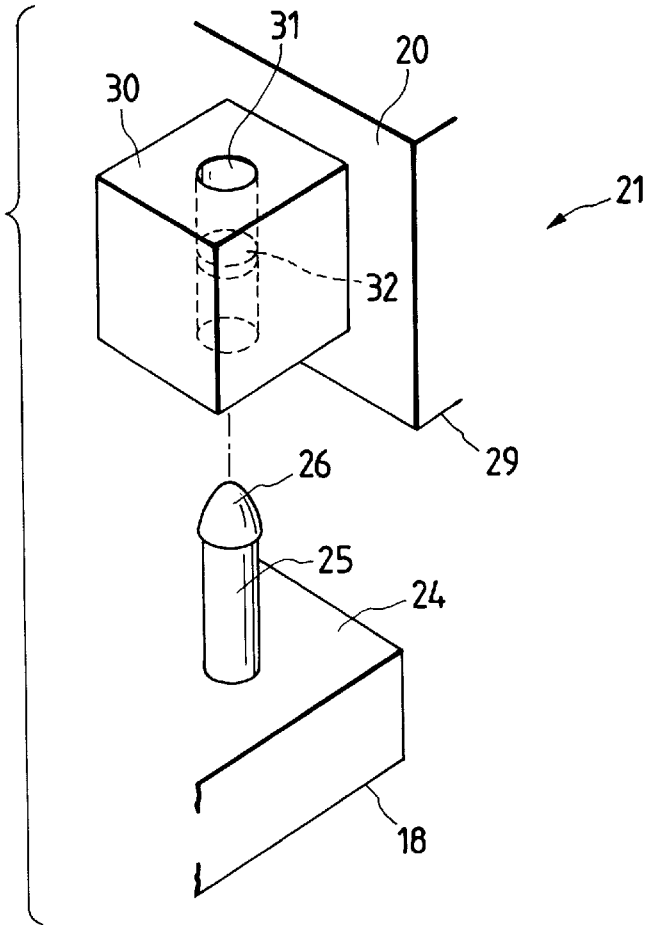
FIG. 4 is a perspective view showing positioning retaining means in the waterproof press-connecting connector of the invention.
Figure 5:
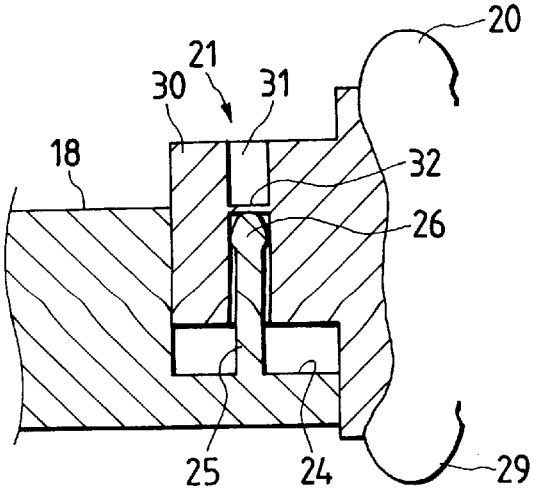
FIG. 5 is a cross-sectional view showing the positioning retaining means.

The rubber plug 20, supported on the rubber plug support portions 24, includes a body 29 having two lip portions 27 and 27 formed on an outer periphery thereof, and a pair of extension portions 30 and 30 projecting from one side of the body 29. Wire insertion holes 28 are formed through the body 29, and extend between the opposite sides thereof. As shown in FIGS. 4 and 5, a hole 31 is formed in each extension portion 30 along an axis thereof. The hole 31 is defined by a cylindrical bore extending from the upper surface to lower surface of the extension portion 30, and a thin wall 32 is formed in the hole 31 intermediate the opposite ends thereof.

As shown in FIGS. 4 and 5, the positioning retaining means 21 is constituted by the pair of projections 25 and the holes 31 formed respectively in the extension portions 30, and the thin walls 32.

Figure 6A:
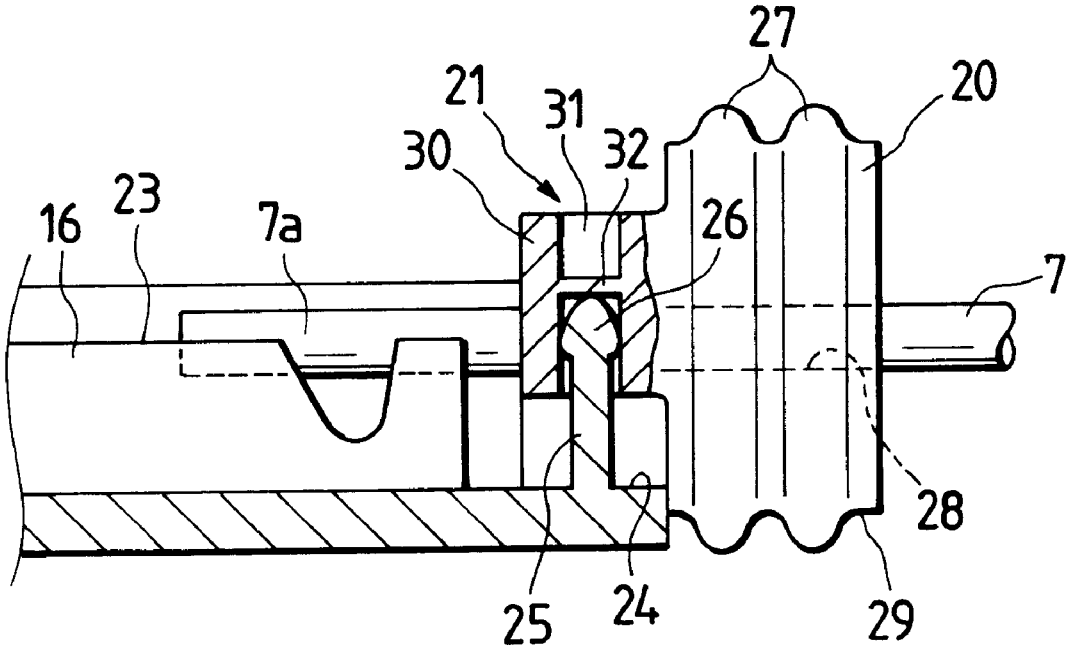
FIG. 6(*a*) is a cross-sectional view showing a condition in which a rubber plug is located and supported in a provisionally-retained position.
Figure 6B:
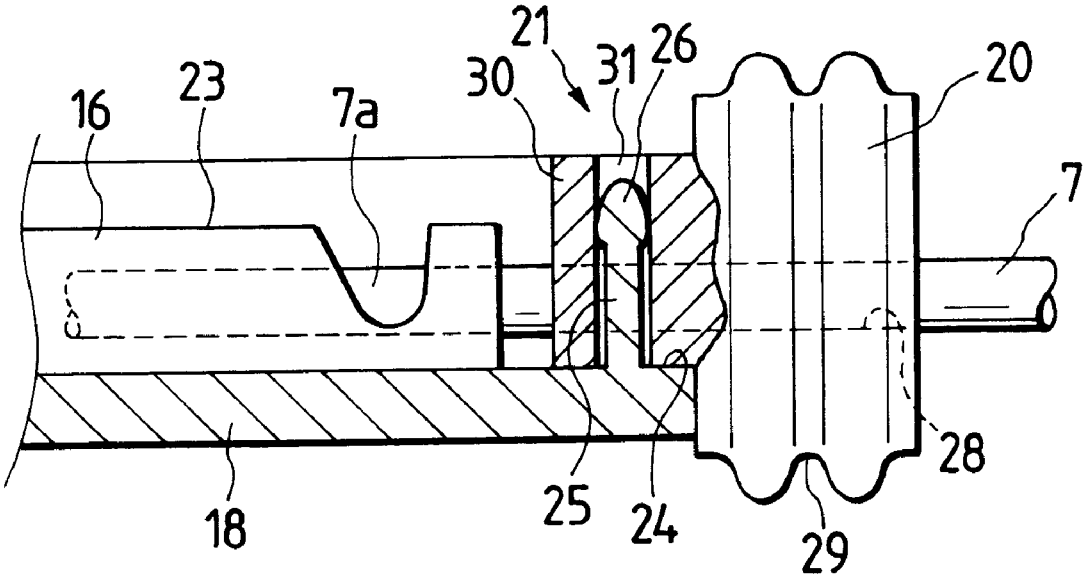

The projections 25 are inserted respectively into the holes 31, and distal ends of the heads 26 are abutted respectively against the thin walls 32, and in this condition the rubber plug 20 is located and supported in the provisionally-retained position, as shown in FIG. 6(*a*). When the rubber plug 20 is pressed downward, that is, the extension portions 30 are moved toward the rubber plug support portion 24, the thin walls 32 are broken through by the distal ends of the projections 25, respectively, and the rubber plug 20 is located and supported in the completely-retained position, as shown in FIG. 6(*b*).

Next, the procedure of assembling this waterproof press-connecting connector, as well as the press-connecting method, will be described. The end portions 7*a* of the sheathed wire 7, passed respectively through the insertion holes 28 in the rubber plug 20, are placed respectively on the press-connecting portions 23 of the press-connecting terminals 16 beforehand received respectively in the housing 18, and the projections 25 are inserted respectively into the holes 31 formed respectively in the extension portions 30. At this time, the distal ends of the projections 25 are abutted respectively against the thin walls 32, so that the rubber plug 20 is held in the provisionally-retained position, and is prevented from moving in a direction of the axes of the wires.

In this condition, the end portions of the sheathed wires 7 are press-fitted respectively into the press-connecting portions 23 by a press-connecting jig. At this time, the rubber plug 20 is positioned and supported in the provisionally-retained position, and therefore will not move in the direction of the axes of the wires 7, and hence will not move to be disposed above the press-connecting terminals 16.

After the end portions of the sheathed wires 7 are press-fitted respectively into the press-connecting portions 23, the rubber plug 20 is moved toward the rubber plug support portion 24. When the rubber plug 20 is thus moved toward the rubber plug support portion 24, the distal ends of the projections 25 break through the thin walls 32, respectively, and are further inserted into the holes 31, thereby supporting the rubber plug 20 in the completely-retained position.

In the waterproof press-connecting connector 15 of this embodiment, when press-fitting the end portions 7*a* of the wires 7 respectively into the press-connecting portions 23 of the press-connecting terminals 16, the rubber plug 20 is located and supported in the provisionally-retained position by the positioning retaining means 21, and therefore will not be moved to be disposed above the press-connecting terminals, and therefore the end portions of the sheathed wires can be properly press-connected respectively to the press-connecting portions.

Therefore, in this waterproof press-connecting connector, the incomplete connection between each wire end portion and the press-connecting terminal, resulting from the movement of the rubber plug 20 to be disposed above the press-connecting terminals 16, is positively prevented.

The rubber plug 20 is supported in the completely-retained position by the positioning retaining means 21, and therefore the rubber plug 20, when fitted in the rear open end of the cover 19, will not be moved, and therefore positively waterproofs the interior of the cover 19.

As described above in the invention of claim 1, when the end portions of the sheathed wires are to be press fitted respectively in the press-connecting blade portions of the press-connecting terminals, the rubber plug is supported in the provisionally-retained position by the positioning retaining means. Therefore, when press-fitting the wire end portions respectively into the press-connecting portions, the rubber plug will not be moved to be disposed above the press-connecting terminal, and the end portion of each sheathed wire can be properly press fitted between the press-connecting blades of the press-connecting terminal.

In the invention, when press-fitting the sheathed wires respectively into the press-connecting blade portions of the press-connecting terminals, the projections are inserted respectively into the holes, and are supported respectively by the support portions, thereby supporting the rubber plug in the provisionally-retained position. Therefore, the rubber plug will not be moved to be disposed above the press-connecting terminals, and also the rubber plug can be supported in the completely-retained position by the positioning retaining means.

In the invention, when press-fitting the sheathed wires respectively into the press-connecting blade portions of the press-connecting terminals, the bosses, formed on the housing, are inserted respectively into the tubular holes formed in the rubber plug, and the distal ends of the bosses are abutted respectively against the thin walls, thereby holding the rubber plug in the provisionally-retained position. Therefore, the wire end portions can be properly press-fitted respectively into the press-connecting terminals. After the sheathed wires are thus press-fitted respectively into the press-connecting blade portions, the rubber plug is moved to the completely-retained position, and as a result the distal end of each boss breaks through the thin wall, and the boss is further inserted into the hole, thereby supporting the rubber plug in the completely-retained position.

In the invention, when the rubber plug is located in the provisionally-retained position and in the completely-retained position, the heads, formed respectively on the distal ends of the projections, prevent the projections from being withdrawn respectively from the holes, thus positively holding the rubber plug in the provisionally-retained position and in the completely-retained position.

In this press-connecting method, the rubber plug is located in the provisionally-retained position, and in this condition the wire end portions are press-fitted respectively into the press-connecting blade portions. Therefore, each wire end portion can be properly press-fitted into the press-connecting blade portion, and can be electrically connected thereto.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A waterproof press-connecting connector comprising:

a housing having terminal receiving chambers for respectively receiving press-connecting terminals each having a press-connecting portion into which an end portion of a wire is press fitted to make an electrical connection between said wire end portion and said terminal;

a tubular cover for receiving and covering said housing;

a rubber plug, through which said wires connected respectively to said press connecting terminals are passed, for closing one open end of said cover to waterproof the interior of said cover; and a positioning and retaining means for supporting said rubber plug, through which said wires are passed, at a rear end defining a wire lead-out side of said housing to thereby prevent said rubber plug from moving in a direction of axes of said wires;

wherein said rubber plug is positioned and retained by said positioning and retaining means in one of a provisionally-retained position where said rubber plug is provisionally retained relative to said housing so as to prevent said rubber plug from moving in said direction of axes of said wires, and a completely-retained position where said rubber plug is completely retained relative to said housing.

2. A waterproof press-connecting connector comprising:

a housing having terminal receiving chambers for respectively receiving press-connecting terminals each having a press-connecting portion into which an end portion of a wires is press fitted to make an electrical connection between said wire end portion and said terminal;

a tubular cover for receiving and covering said housing;

a rubber plug, through which said wires connected respectively to said press connecting terminals are passed, for closing one open end of said cover to waterproof the interior of said cover; and a positioning and retaining means for supporting said rubber plug, through which said wires are passed, at a rear end defining a wire lead-out side of said housing, to thereby prevent said rubber plug from moving in a direction of axes of said wires;

wherein said rubber plug is positioned and retained by said positioning and retaining means in one of a provisionally-retained position, where the end portions of said wires are disposed respectively above said press-connecting portions and said rubber plug is prevented from moving in said direction of axes of said wires, and a completely-retained position, where said wire end portions are press-fitted respectively into said press-connecting portions.

3. A waterproof press-connecting connector comprising:

a housing having terminal receiving chambers for respectively receiving press-connecting terminals each having a press-connecting portion into which an end portion of a wire is press fitted to make an electrical connection between said wire end portion and said terminal;

a tubular cover for receiving and covering said housing;

a rubber plug, through which said wires connected respectively to said press connecting terminals are passed, for closing one open end of said cover to waterproof the interior of said cover; and a positioning and retaining means for supporting said rubber plug, through which said wires are passed at a rear end defining a wire lead-out side of said housing, to thereby prevent said rubber plug from moving in a direction of axes of said wires;

wherein said positioning and retaining means comprises:

a pair of projections projecting from the rear end of said housing in a direction opposite to a direction of press-fitting of said wire end portions into the respective press-connecting portions;

a pair of recess portions, formed in said rubber plug, into which said projections are inserted respectively; and support portions, formed on said pair of recess portions, respectively supporting said pair of projections in said pair of recess portions so that said rubber plug can be retained relative to said housing in said provisionally-retained position and said completely-retained position.

4. A waterproof press-connecting connector according to claim 3, wherein:

said recess portions include a pair of holes which are formed respectively in a pair of block-like extension portions and made to receive said projections, each of said projections comprises a cylindrical boss, said support portions are defined respectively by thin walls, each formed respectively at an intermediate portion between the opposite ends of said holes, said support portions abut respectively against said bosses inserted respectively into said holes, to support said rubber plug in said provisionally-retained position, and when said bosses are further inserted respectively into said holes, said thin walls are broken through by said bosses, respectively, to allow said rubber plug to move to said completely-retained position.

5. The waterproof press-connecting connector according to claim 3, wherein a head for preventing said projection from being withdrawn from said recess portion is formed at a distal end of each of said projections.

6. The waterproof press-connecting connector according to claim 4, wherein a head for preventing said projection from being withdrawn from said hole is formed at a distal end of each of said projections.

7. A press-connecting method of pressing connecting end portions of wires respectively to press-connecting terminals in a waterproof press-connecting connector, said press-connecting method comprising the following steps in the sequence set forth:

moving a rubber plug, through which said wires have been passed, at a provisionally-retained position where said rubber plug is provisionally retained relative to a housing so as to prevent said rubber plug from moving in a direction of axes of said wires;

placing and fitting said end portions of said wires respectively on the press-connecting portions of said press-connecting terminals so as to electrically connect said wires to said press-connecting terminals;

moving said rubber plug from the provisionally-retained position to a completely-retained position where said rubber plug is completely retained relative to said housing.

* * * * *